US007665610B2

(12) United States Patent
Williams-Hartman

(10) Patent No.: US 7,665,610 B2
(45) **Date of Patent: *Feb. 23, 2010**

(54) CHILD-RESISTANT AND SENIOR-FRIENDLY BLISTER CARD PACKAGE

(76) Inventor: Wade Everette Williams-Hartman, 53 Hubbardton Rd., Wayne, NJ (US) 07470

( * ) Notice: Subject to any disclaimer, the term of this patent is extended or adjusted under 35 U.S.C. 154(b) by 217 days.

This patent is subject to a terminal disclaimer.

(21) Appl. No.: 11/707,434

(22) Filed: Feb. 16, 2007

(65) Prior Publication Data

US 2007/0199858 A1 Aug. 30, 2007

Related U.S. Application Data

(63) Continuation of application No. 10/394,495, filed on Mar. 20, 2003, now Pat. No. 7,188,728.

(51) Int. Cl.
*B65D 83/04* (2006.01)

(52) U.S. Cl. ..... 206/532; 206/531

(58) Field of Classification Search ..... 206/528, 206/530, 531, 532, 533, 538, 539
See application file for complete search history.

(56) References Cited

U.S. PATENT DOCUMENTS 3,610,410 A * 10/1971 Seeley ..... 206/468
3,811,564 A * 5/1974 Braber ..... 206/469
4,294,361 A * 10/1981 Margulies et al. ..... 206/532
4,889,236 A * 12/1989 Bartell et al. ..... 206/531
4,988,004 A * 1/1991 Intini ..... 206/532
5,325,968 A * 7/1994 Sowden ..... 206/532
6,161,699 A * 12/2000 Gartland ..... 206/531
6,273,260 B1 * 8/2001 ColDepietro et al. ..... 206/532
6,394,275 B1 * 5/2002 Paliotta et al. ..... 206/531
6,705,467 B1 * 3/2004 Kancsar et al. ..... 206/531
2002/0100709 A1 * 8/2002 Shibata ..... 206/469
2003/0006163 A1 * 1/2003 Patterson ..... 206/531

* cited by examiner

*Primary Examiner*—Kurt Fernstrom
(74) *Attorney, Agent, or Firm*—Ward & Olivo

(57) ABSTRACT

The present invention is a novel child-resistant senior-friendly blister card packaging that is cheap and easy to manufacture. The packaging requires a push-peel-push method for opening, which is cognitively and physically challenging for children and mentally impaired adults. Yet, competent adults can easily open the package, especially after reading instructions. More specifically, opening the package requires the user to: 1) Push through a aperture to create a pull tab; 2) Pull on the pull tab to remove a panel; and 3) Push the blister to force the contents through the blister's seal. Advantageously, the present invention is designed such that information such as instructions and product information can be easily printed directly on the packaging. Moreover, users may also record information directly on the packaging. Thus, the present invention not only provides child-resistant and senior-friendly features, but also provides convenience for viewing and recording information.

4 Claims, 9 Drawing Sheets

CHILD-RESISTANT AND SENIOR-FRIENDLY BLISTER CARD PACKAGE

RELATED SUBJECT MATTER

This application is a continuation of application Ser. No. 10/394,495, filed Mar. 20, 2003 now U.S. Pat. No. 7,188,728 which is hereby incorporated by reference.

TECHNICAL FIELD OF THE INVENTION

The present invention relates to blister card packages designed to distribute products such as pharmaceutical drugs. More particularly, the present invention relates to blister card packages designed to distribute pharmaceutical drugs that provide senior citizens easy access to the contained drugs while providing difficult access for a child. The present invention is ideally suited for use with pharmaceutical drugs or clinical trial drugs, but may be used to distribute any product that may be contained within a blister card package.

BACKGROUND OF THE INVENTION

Blister card packages are commonly used for distribution of many products including pharmaceutical drugs, batteries, sewing kits, toy cars, etc. A blister card package is used as a stiffener or backing sheet for packaging a product contained in a blister, which may comprise a blister strip having a single row of individual blisters, or a solid form blister having a two-dimensional matrix of individual blisters (which will be discussed in more detail below). Typically, the blister card package is comprised of pre-printed stiff paper, such as cardboard, that is folded to create at least two adjacent sides. One or both of the sides typically contains an aperture. The product to be packaged is usually encased in a clear plastic individual blister, which may be inserted between the two adjacent sides of the blister card package such that the product protrudes from one or both apertures. The two cardboard sides are then sealed, typically via application of heat and pressure, to retain the plastic individual blister within its blister card packaging.

Blister card packages may accommodate individual blisters (as illustrated above) or may be designed to accept blister strips or solid form blisters. The latter are commonly used to package pharmaceutical drugs for public distribution or clinical trials. Pharmaceutical drugs are distributed in many forms such as capsule, pill, lozenge, etc., which are amenable to distribution in blister strips or solid form blisters.

A blister strip comprises a contiguous strip of plastic individual blisters having a common backing, such as foil, that is one unit wide by any number of units long. In contrast, solid form blisters comprise both horizontal and vertical rows of individual blisters, however, solid form blisters also typically share a common backing.

Blister strips and solid form blisters are popular containers for pharmaceutical drugs because the strips may be specially configured to meet the dosage requirements of the drug. For example, an antibiotic drug prescription may require 16 pills to be taken in a specific order. The blister strip or solid form blister may be manufactured such that the pills are packaged in the same order that the pills should be taken. The blister strip or solid form blister may then be packaged in a pre-printed blister card package that contains printed instructions regarding when and how to take each dose. (Additionally, the insertion of one 16-dose strip or one 4-dose wide by 4-dose long solid form blister into a blister card package is much easier to perform than the insertion of 16 distinct blisters arranged in a specific order). Therefore, pharmaceutical drugs distributed to the public or used in clinical trials are typically packaged in blister strips or solid form blisters contained within a sealed blister card package.

Many blister card packaged products, especially pharmaceutical drugs, can be harmful, or even lethal, to children or mentally impaired adults. At the same time, however, the products contained in blister card packages may be vital to the health of other adults including senior citizens, some of which may have impaired physical and cognitive skills and/or poor eyesight. Consequently, it is desirable to manufacture blister card packages that impede a child's access to the product contained in the blister while simultaneously facilitating a senior citizen's access to its content. Such packaging is known in the art and is commonly referred to as child-resistant and senior-friendly packaging.

The federal government has implemented various laws to ensure that materials deemed by the government to be dangerous are packaged in child-resistant and senior-friendly packaging. Specifically, the federal government enacted the Poison Prevention Act of 1970 ("PPA") (Pub. L. 91-601, 84 Stat. 1670, 15 U.S.C. 1471-75) on Dec. 30, 1970, which is incorporated herein by reference. The Poison Prevention Act of 1970 requires harmful substances to be packaged in child-resistant packaging, i.e., such that children under 5 years of age, having no physical or mental handicaps, cannot "open or obtain a harmful amount of the substance contained therein within a reasonable time" and senior-friendly packaging, i.e., such packaging must also "not [be] difficult for normal adults to use properly." Notably, the PPA does not require that children be prevented from opening or obtaining a toxic or harmful amount of the substance 100 percent of the times attempted. When the substance is packaged in individual units, the Code of Federal Regulations requires that child-resistant packaging is effective no less than 80 out of every 100 attempts (16 C.F.R. 1700.15(b)(1)). Conversely, senior adults between ages 50 and 70, having no mental or physical disabilities, should be able to open the packaging no less than 90 out of every 100 attempts when permitted to view printed instructions that accompany the packaging (16 C.F.R. 1700.15(b)(2) (i-ii), 16 C.F.R. 1700.20(a)(3)(i), 16 C.F.R. 1700.20 (a) (3) (iv)).

To ensure compliance with the aforementioned federal guidelines, blister card packaging is submitted to a testing agency, which determines the child-resistance rating and whether or not the packaging is senior-friendly. Packaging is rated as senior-friendly solely based on the 90 percent guideline, i.e., senior adults are able to, open the packaging at least 90 times out of every 100 attempts. However, the child resistance rating is determined on a scale ranging from F1 through F8. The F represents "fatal at" and the following number represents the number of doses, therefore, F4 is "fatal at 4 doses". (Consequently, the more difficult it is for a child to access a product contained within a blister card package, the lower the child-resistance rating applied to the packaging). It is intuitive that products contained within packaging rated at F1, i.e., lethal at one dose, should be very difficult for children to access, whereas, products rated at F8, i.e., lethal at 8 doses, do not require the same level of difficulty. A blister card package that is to be used for distribution of potentially lethal pharmaceutical drugs or clinical trial drugs must pass the aforementioned federal guidelines prior to use. Additionally, the child resistance rating will determine what type of pharmaceutical drugs can be distributed within each rating of packaging, i.e., a pharmaceutical drug that is lethal at three doses cannot be packaged in a blister card package that is rated F4 through F8. When the lethal dose of a drug has not been established, federal regulations require an assumption that the drug is lethal at eight doses, therefore, such a drug may be distributed in packaging rated F8.

Blister card packages exist today that have passed the federal child-resistant and senior-friendly testing guidelines. Many existing, patented blister card packages were originally designed for distribution of non-lethal drugs and, therefore, were not required to pass the federal testing guidelines. To sell to a larger market of users, these blister card packages were modified to achieve child-resistance using a variety of methods including adding paperboard layers, adding plastic or tape layers to the exterior of the paperboard, reinforcing a frangible foil backing with a less frangible paper, etc.

After the aforementioned modifications were made, many blister card packages that were previously non-child-resistant were able to pass child resistance testing, however, the packaging became undesirable in other ways. For example, the additional, reinforced layers often prevented the pills from being pushed cleanly through the blister backing and thereby caused degradation of the backing of other adjacent pills. Specifically, some blister card package manufacturers have added a layer of paper to the foil backing through which a pill is pushed. The paper and/or foil backing sometimes does not tear cleanly, leaving the user only one option: scraping the backing until enough of it is removed to allow the user to grasp and peel the backing enough to reach the pill. This can be very difficult, especially for senior citizens or other adults with impaired physical abilities.

Furthermore, once the backing is grasped and torn, a user can easily tear too much backing, exposing other blisters. Consequently, the child resistance capabilities of the adjacent blister with the partially torn backing is lessened, thereby creating a potentially lethal hazard for children. Additionally, the user may not be able to scrape the backing to the point where the backing may be pulled, causing the user to resort to a sharp object such as a knife or scissors. Cutting of the blister card packaging can lead to many more problems including degradation of the child resistance properties of the other blisters, damage to the unused pills, damage to the printed instructions advising the user when and how to take the pills, etc.

Alternatively, if a user cannot remove the reinforced layer of the blister backing such that the pill is easily pushed through the non-reinforced layer of the blister backing, the user may attempt to force the pill through the reinforced backing. This leads to at least two major problems. First, damage may result to the content of the blister rendering those contents unusable. For example, if the blister contains a pharmaceutical drug contained in capsule form, the pressure exerted on the capsule may cause the capsule to burst, rendering it unusable. This can be very dangerous to the health of the user. Second, the user may resort to bending the overall blister card package causing damage to the blister, adjacent blisters, blister backings, and the content of the blisters, which again may be very dangerous to the health of the user. All of the aforementioned problems exist with the blister card packages known in the art.

In addition to the safety concerns discussed above, inferior blister card packaging also increases the cost of pharmaceutical drug clinical trials, which are required by the Federal Food and Drug Administration ("FDA"). Prior to submission of clinical trial results to the FDA, a specified minimum number of clinical trial participants must successfully complete the clinical trial.

Many clinical trials are "double-blind," i.e., both the subject and the administrators are unaware of which participant is receiving a particular drug. Thus, blister strips or solid form blisters contain information regarding each drug for use in an emergency, however, the blister card package hides the drug identification information from the participant. If the empty blister card package is degraded, the clinical trial participant may be exposed to the drug identification, causing that participant's results to be discarded. The reason for this is that if a participant is aware of which pill is a placebo versus an actual drug, the participant's response to each pill may be compromised because they are expecting a certain response. Therefore, use of blister card packages that are easily degraded adds to the cost of clinical trials because another participant must be found, and possibly paid, and a supervising physician must be paid to supervise the additional participant, which may cost the drug manufacturer as much as $50,000 per participant. Depending on the effectiveness of the blister card package, among other factors, a pharmaceutical company may be required to recruit 120 participants to expeditiously complete a clinical trial requiring 80 successful participants, thereby unnecessarily adding to the cost of clinical trials.

The following references are provided to further illustrate the state of the art of blister card packages as described above: Compere U.S. Pat. No. 3,809,221 (hereinafter referred to as "Compere"); Davie, Jr. et al. U.S. Pat. No. 4,125,190 (hereinafter referred to as "Davie"); Dlugosz U.S. Pat. No. 4,506,789 (hereinafter referred to as "Dlugosz"); Intini U.S. Pat. No. 4,537,312 (hereinafter referred to as "the Intini '312 patent"); Intini U.S. Pat. No. 4,988,004 (hereinafter referred to as "the Intini '004 patent"); Wharton et al. U.S. Pat. No. 5,172,812 (hereinafter referred to as "Wharton"); Bitner et al. U.S. Pat. No. 5,310,060 (hereinafter referred to as "Bitner"); Sowden U.S. Pat. No. 5,325,968 (hereinafter referred to as "Sowden"); Price U.S. Pat. No. 5,339,960 (hereinafter referred to as "Price"); Matthews et al. U.S. Pat. No. 5,469,968 (hereinafter referred to as "Matthews"); Leblong U.S. Pat. No. 5,758,774 (hereinafter referred to as "Leblong"); Vasquez et al. U.S. Pat. No. 5,775,505 (hereinafter referred to as "Vasquez"); Dressel et al. U.S. Pat. No. 5,785,180 (hereinafter referred to as "Dressel"); Plezia et al. U.S. Pat. No. 5,862,915 (hereinafter referred to as "Plezia"); Faughey et al. U.S. Pat. No. 5,878,888 (hereinafter referred to as "the Faughey '888 patent"); Faughey et al. U.S. Pat. No. 5,894,930 (hereinafter referred to as "the Faughey '930 patent"); Godfrey et al. U.S. Pat. No. 5,927,500 (hereinafter referred to as "Godfrey"); Ray et al. U.S. Pat. No. 5,944,191 (hereinafter referred to as "Ray"); Gartland U.S. Pat. No. 6,161,699 (hereinafter referred to as "Gartland"); Danville U.S. Pat. No. 6,338,407 B2 (hereinafter referred to as "Danville"); and Swartz U.S. Pat. No. 6,422,391 B1 (hereinafter referred to as "Swartz").

Compere; the Intini '312 patent, Wharton, Price, and Dressel disclose child-resistant blister card packaging having two layers covering the opening to each blister. To access the product contained within the blister, the user first peels an outer non-frangible layer, such as stiff paper, to expose an underlying frangible layer, such as thin foil. The underlying frangible layer comprises a material that allows the user to push the product contained within the blister through the frangible layer. This type of packaging is referred to as peel-push.

A few problems exist with peel-push blister card packaging. One such problem is the difficulty involved with grasping the outer layer such that it may be peeled. Since many outer layers are difficult to grasp, users tend to bend the overall packaging or use sharp objects to remove the outer layer, which results in damage to the packaging of the remaining products. In particular, some of these outer layers are so difficult to grasp that senior citizens or other adults suffering from diminished physical abilities or poor eyesight may not be able to access the blister product without assistance. Also, the damage to the remaining packaging diminishes its child resistance.

Another problem with peel-push packaging is that even if the user is able to grasp the outer layer, the user sometimes removes more of the outer layer than that which covers the desired product. Therefore, the frangible layer of other adjacent products that the user does not intend to remove is exposed. Again, this problem causes the child resistance rating of the adjacent product to be reduced, if not totally eliminated.

Davie also discloses peel-push blister card packaging. However, to remove the content of the blister as disclosed in Davie, the user peels away a tear strip that exposes the frangible foil backings of an entire row of blisters. After the tear strip is removed, the user may push the content of any blister in the row through its respective foil backing. The blister card packaging disclosed in Davie suffers the same limitations as other peel-push packaging, i.e., it is difficult to grasp the outer layer prior to peeling and the Davie product is actually designed to expose the frangible layer of products that are not ready to be removed. This aspect obviously diminishes the child resistant capabilities of the unopened package.

Dlugosz also discloses a peel-push blister card package, however, Dlugosz discloses a method that requires the user to first bend the package. The blister card package disclosed in Dlugosz comprises a paperboard sheet folded to create two adjacent paperboard sheets. The blisters are inserted between the two adjacent paperboard sheets and contain a frangible backing through which the user may push the content of the blister. To expose the frangible backing, the user removes a tear strip located on one of the paperboard sheets. The user grasps the tear strip by bending the edge of the paperboard to access a leading tab, which assists in the removal of the tear strip. Although Dlugosz discloses a better method of grasping the tear strip, Dlugosz still requires bending the packaging. Also, Dlugosz does not disclose a method that prevents the user from tearing more of the backing than necessary to expose the frangible layer of the desired product. Finally, the tear strip may still be difficult to grasp for senior citizens or other adults suffering from diminished physical abilities.

Similar to Dlugosz, the Intini '004 patent discloses a blister card package that requires the user to perform a "bend-peel-push" method to remove the content. First, the user bends the entire blister card package to expose a pull-tab. Then, the pull-tab may be used to peel away the outer layer of the card such that only the frangible layer remains. The content of the blister may then be pushed through the frangible layer. Although the Intini '004 patent discloses a better method of grasping the outer non-frangible layer, the Intini '004 patent still requires bending the packaging which may be difficult for frail adults, especially those suffering from an ailment such as arthritis. Furthermore, because the Intini '004 patent requires both foil and paper frangible layers, it is difficult to push the product through the two frangible layers. This added resistance makes the card unsuitable for soft capsules, gel caps, and soft tablets/caplets. Furthermore, seniors have a more difficult time pressing products through the thicker frangible layers.

Bitner discloses a blister card package that requires a user to break a T-shaped perforation to access a corner of a non-frangible layer. The non-frangible layer may then be peeled away to expose the frangible layer. Subsequently, the user may push the content of the blister through the frangible layer. Although the additional layer containing the T-shaped perforation may provide a higher child resistance rating, the additional layer also adds another level of complexity for those users who suffer from diminished physical abilities or poor eyesight.

Sowden discloses a blister card package that requires the user to perform multiple steps to remove the content of the blister. Initially, the user must remove a single blister from a solid form blister. Next, the user peels a first strip from the single blister. Once the first peelable strip is removed, a depression is exposed that allows the user to peel away the backing of the blister, thereby gaining access to the content of the blister. Similar to the packaging disclosed in Bitner, although the additional complexity required to access the content of the blister might achieve a higher child resistance rating, the additional complexity also makes the content of the blister less accessible to those users who suffer from diminished physical abilities or poor eyesight.

Matthews discloses a blister card packaging comprising three distinct layers. The first, innermost layer is frangible, and the second and third outer layers are non-frangible. Moreover, the second and third layers are perforated in two distinct patterns. Therefore, the user initially removes the third, outermost layer according to its perforation pattern. Then, the second outermost layer is removed according to its distinct perforation pattern. Finally, the content can be pushed through the innermost frangible layer. The packaging disclosed in Matthews suffers from the same limitations as the aforementioned packaging containing two distinct layers, namely, the additional level of complexity required to access the product and the possibility that the user tears more of the backing than required, thereby reducing the child resistant properties of the packaging of the remaining products. However, these limitations are magnified by the addition of a third layer, i.e., the outermost, non-frangible layer.

Vasquez discloses a blister card package that requires a user to remove an individual blister from a solid form blister via perforations in the non-frangible layer. Once the individual blister has been isolated from the solid form blister, a pull-tab is exposed on the corner of the backing of the individual blister. The user then pulls the pull-tab to peel away the backing and access the content of the blister. Again, the Vasquez packaging requires multiple, intricate steps that will be difficult to perform by users suffering from diminished physical abilities or poor eyesight.

Leblong discloses a blister card package that requires the user to tear away two strips before accessing the content of a blister. The first strip is formed on the edge of a solid form blister. Once the first strip is torn away, multiple pull-tabs form a series of secondary strips are exposed. The user may then pull away an individual secondary strip by pulling the respective pull-tab, thereby exposing a frangible layer covering a row of blisters. Thereafter, the content of any blister in the row may be removed by pushing the content of the blister through the frangible layer. Again, when the blister card packaging is used to package pharmaceutical drugs, removing the non-frangible layer from an entire row of pills degrades the child resistance of the pills in the row that are not immediately removed.

Plezia, the Faughey '888 patent, the Faughey '930 patent, and Ray disclose blister card packages that require the user to press on a specified area of the blister card package to create a pull tab. Thereafter, the pull-tab may be pulled to remove the backing from the blister and expose the blister content. However, none of these patents disclose a method that prevents the user from removing more of the backing than that which covers the intended blister or blisters. In addition, although the pull-tab facilitates removal of the blister backing for an adult, the pull-tab also facilitates removal of the blister backing for a child.

Godfrey discloses a folded blister card package that encloses a blister, blister strip, or solid form blister. The side of the folded blister card that faces the blister backings comprises a series of oval perforations. To eject the content of a blister, the user simply presses the top of the blister forcing the content of the blister through the foil backing and the respective oval perforation, causing a hole to form in the blister card packaging through which the content of the blister may pass. If the rigidity of the perforated ovals is low, the packaging disclosed in Godfrey allows a child to have easy access to the blisters' content. In contrast, if the rigidity of the perforated ovals is high, the Godfrey packaging impedes access to the blisters' content for adults having impaired physical abilities.

Similar to Godfrey, Gartland also discloses a blister card package comprising a series of perforated ovals, however, Gartland discloses a layer of plastic film that covers the perforated ovals. To remove the perforated ovals, the user must first peel the plastic film from the ovals. The perforated ovals can then be removed such that the foil backing of the blisters are exposed. The user then pushes on an individual blister to force the blister content through the blister backing. These three steps can be very difficult for a senior citizen, or other adult, having impaired physical abilities. Such individuals may resort to sharp objects for removal of any of the aforementioned layers, which is likely to damage the packaging. In a clinical trial, the results of a participant that returns damaged, empty packaging may be discarded, thereby increasing the total number of participants and the cost of the clinical trial.

Danville discloses blister card packaging that also requires the user to perform a series of steps to access the blisters' content. First, the user must remove a group of blisters by pushing the group through a perforated section of the blister card package. Once the blister group is removed from the blister card package, a second perforation is exposed. The user then uses the second perforation to grab and tear the packaging in the area adjacent to the desired blister. Along the tear, there is an area wherein the portion of the backing being torn and the underlying backing are not adhered together. At this location, the layers may be easily separated allowing the innermost backing to be easily peeled away from the blister. Whereas the lack of adhesion between the outer and inner layers of the backing facilitate removal of the backing, the multiple peels required to remove the blister's content renders the Danville packaging difficult for adults having impaired physical abilities.

Finally, Swartz provides a blister card package that requires the user to tear the blister card package in two directions. Prior to tearing the blister card package, the user must remove a blister segment via a perforated section of the blister card package. Each blister segment comprises two lines cut in the blister segment backing such that the two lines merge on one side of the backing and are separated on the other side of the backing. Therefore, by pushing between these two lines at the point where the two lines merge, the user may create a pull-tab that may be used to begin tearing the segment backing. Finally, to access the content of the desired blister, the user continues to tear the previously torn backing in the direction of the desired blister. The blister card packaging disclosed in Swartz does not contain a method of preventing more than the desired backing from being torn. Additionally, the pressure exerted on the packaging to form the pull-tab may damage the packaging.

Thus, there is a clear need for child-resistant and senior-friendly blister card packaging that achieves a high child resistance rating when tested while remaining easy to use for senior citizens, including those with diminished physical abilities and/or poor eyesight. There is a further need for child-resistant and senior-friendly packaging equipped with a non-frangible backing that tears cleanly such that the frangible layer of only one individual blister is exposed, thereby maintaining the child resistance rating of adjacent individual blisters. Finally, there is also a need for a child-resistant and senior-friendly packaging that allows a tear strip to be torn and a the content of the individual blister to be pushed through a frangible layer without bending the entire blister card packaging or resulting to the use of sharp objects to access the individual blisters' content.

SUMMARY OF THE INVENTION

Generally, the present invention provides an improved child-resistant and senior-friendly blister card package particularly suited to distribution of pharmaceutical drugs for public or clinical trial use. Specifically, the blister card package of the present invention achieves federally mandated child-resistant and senior-friendly guidelines while providing a blister card package that is easy to use for all adults including those with impaired physical abilities. Additionally, the blister card package of the present invention allows an individual pharmaceutical drug to be removed cleanly from its individual blister without damage to the blister card package or the pharmaceutical drugs contained in the blister card package and without degrading the child resistance rating of the blister card packaging enclosing the remaining pharmaceutical drugs.

The blister card package of the present invention is used to encase an individual blister, blister strip, or solid form blister as described above. After one or more of the blister segments are inserted into the blister card package, the blister card package is sealed around the blister segment, typically via the application of pressure and heat. The blister card package and contained blister segment(s) are then distributed to individual users. The user accesses the content of the individual blister using a push-peel-push method, as described in the instructions printed on the paperboard of the blister card package and in further detail below.

First, the user pushes a specially marked, color-coded target area with an object, such as a pen, fingernail or a specially designed tool, which may be provided with the blister card package, to form a pull-tab. The use of a tool to create a pull-tab minimizes the physical strength required by the user. One such tool is specially designed for use with arthritic hands. It has a wide base for holding the tool and a small end for pushing the target area on the blister card. The color-coded target area facilitates use for users suffering from diminished eyesight. Additionally, pushing the tool through a specially marked target area that is separate from the individual blister, as compared to bending the blister card package or pushing the individual blister, prevents damage to the blister card package and its contents and also maintains the child-resistance of the packaging.

Each individual blister and has an associated target area and die-cut portal. Pushing the specially marked target area causes the die-cut portal in the paperboard backing (i.e., the backing that reinforces the foil backing of the blister segment) to break away from the remainder of the paperboard backing. The pushed portion of the die-cut portal forms a tab that may be used to peel the remainder of the die-cut portal from the paperboard backing, thereby exposing the frangible layer covering the individual blister opening. Due to the unique manufacturing method of the blister card package, as discussed in greater detail below, the die-cut portal is removed completely and easily without removing any of the paperboard surrounding the die-cut portal, thereby maintaining the child resistance rating and the structural integrity of the blister card package. Finally, the content of the designated individual blister may be pushed through the frangible backing.

To manufacture the blister card of the present invention, a single sheet or multiple sheets of a material such as paperboard, cardboard, or another similar material may be used. For exemplary purposes, manufacturing with a single sheet of paperboard will be described. First, the paperboard sheet is cut. The cut of the sheet will be based partly on the specifications of the items to be packaged, i.e., pharmaceutical drugs pre-packaged in 4×4 solid form blisters, and partly on the blister card manufacturer's method of achieving child-resistant and senior-friendly standards.

The child-resistant and senior-friendly attributes of the present invention are created by two distinct cuts per blister on the front card and a unique bi-level cut on the rear card. The front card is the portion of the paperboard sheet that will be placed on top of the blisters and the rear card is the portion of the paperboard sheet placed behind the foil backing of the blister segment. One of the two distinct cuts per individual blister on the front card provides an aperture through which the individual blister is placed. The second, adjacent cut, which is preferably a perforated cut, borders the color-coded target area that is pushed to create the pull-tab. The bi-level cut on the rear card includes one perforated cut, which completely penetrates the paperboard, and one cut-score, which partially penetrates the paperboard. In the preferred embodiment of the present invention, the perforated cut comprises an oval that surrounds the blister opening and the specially marked target area associated with the blister. The cut-score is also oval, but slightly smaller than the perforated cut.

The cut score is located on the interior of the blister card package to facilitate a clean tear of the die-cut portal only when the portal is pressed from the inside of the blister card package, via the front of the package. Therefore, the cut score does not facilitate a clean tear if the user does not follow the directions. For example, it will be very difficult for a child playing with the package to tear the portal from the exterior of the package without using a tool to push the portal through the front of the card. Additionally, the length and size of the cuts and landings (i.e., the intact portions between the cuts, that form the portal can be varied to regulate the difficulty with which the portal is removed.

Furthermore, using paperboard or some other printable material to create the blister card package allows each individual blister to be labeled with usage instructions. The recommended time and/or day of use of for each blister's contents can be printed adjacent to each blister. Additionally, blank areas may be provided adjacent to each blister such that a user or administrator may easily write, or otherwise record, information (e.g., when the contents were used, a patient's blood pressure or temperature, etc.). Furthermore, opening directions may be printed on other areas of the paperboard to allow a user to easily learn how to open the package. In addition to printed instructions, fold lines may be used to segregate the contents into sections.

Segregation of the blister contents, either by printing or folding, allows different medications to be packaged in a single blister card package while allowing the user to easily distinguish them. Additionally, the sections may be chronologically arranged. For example, each section may include blister contents that are to be removed on the same day. Alternatively, each section may represent a specific week, month, etc. Fold lines may also be used to separate the opening instructions from the blister contents. For example, when the blister card package is unfolded, the instructions describing the push-peel-push method of accessing the blister content may appear to the left side of the fold line and the blister contents may be packaged to the right side of the fold line.

For all of the aforementioned reasons, the blister card package of the present invention is particularly suited to distribution of pharmaceutical drugs for clinical trials, which require the participants to take specific drugs at specified times and to record the effects of the drugs. Additionally, the present invention allows the drugs contained within the blisters to be labeled such that each drug remains unknown to the participant unless the blister card packaging is torn apart. Since the blister card packaging is returned to the administrator of the clinical trial, the anonymity of the blister card drugs can be verified. Consequently, the integrity of double-blind testing procedures can be maintained while permitting access to drug information in emergency situations.

It is an object of the present invention to provide packaging that is difficult for young children and mentally impaired adults to open.

Additionally, it is an object of the present invention to provide packaging that is easily accessible to competent adults and senior citizens including those with impaired physical abilities.

It is also an object of the present invention to provide child-resistant and senior-friendly packaging that passes federally mandated guidelines.

Also, it is an object of the present invention to provide packaging that is easily and inexpensively manufactured.

Further, it is an object of the present invention to provide blister card packaging that allows an individual blister's contents to be easily and cleanly removed without damage to the blister card package, individual blister contents, or adjacent blister backings.

Additionally, it is an object of the present invention to provide blister card packaging that allows a blister's contents to be easily and cleanly removed without degrading the child resistance rating of the packaging of the remaining blisters.

In addition, it is an object of the present invention to provide blister card packaging that allows instructions to be printed directly on the packaging.

It is yet another object of the present invention to provide blister card packaging that provides information to the user such as the content of an individual blister.

Moreover, it is an object of the present invention to provide blister card packaging that organizes the blister contents chronologically, chemically, functionally, etc.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

SUMMARY OF THE DRAWINGS

A further understanding of the present invention can be obtained by reference to a preferred embodiment, along with some alternative embodiments, set forth in the illustrations of the accompanying drawings. Although the illustrated embodiments are merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended of as subsequently amended, but merely to clarify and exemplify the invention.

For a more complete understanding of the present invention, reference is now made to the following drawings in which.

DETAILED DESCRIPTION OF THE PREFERRED EMBODIMENTS

As required, detailed illustrative embodiments of the present invention are disclosed herein. However, techniques, systems and operating structures in accordance with the present invention may be embodied in a wide variety of forms and modes, some of which may be quite different from those in the disclosed embodiments. Consequently, the specific structural and functional details disclosed herein are merely representative, yet in that regard, they are deemed to afford the best embodiments for purposes of disclosure and to provide a basis for the claims herein which define the scope of the present invention. The following presents a detailed description of a preferred embodiment (as well as some alternative embodiments) of the present invention.

Figure 1A:
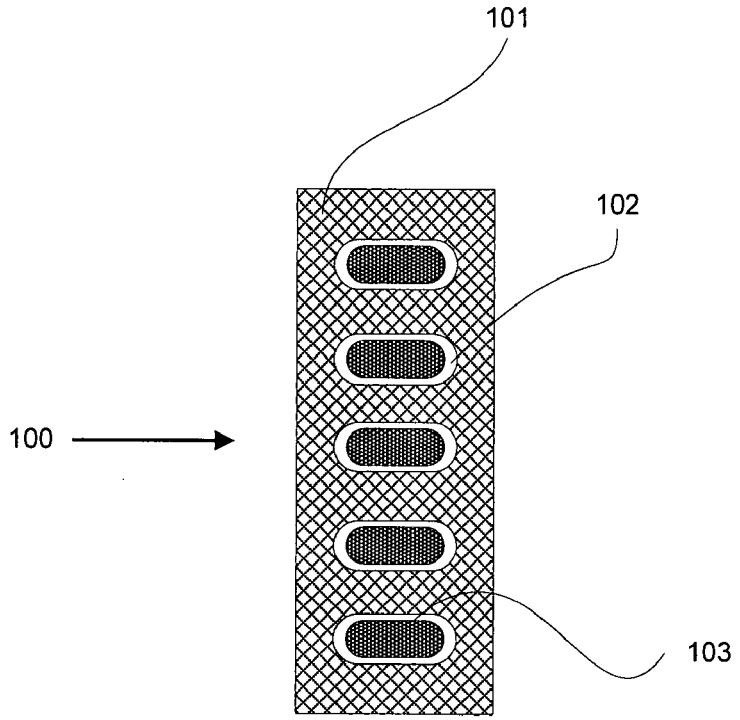
FIG. 1A depicts a front plan view of a blister strip for use with the preferred embodiment of the present invention.

FIG. 1A depicts a front plan view of a blister strip for use with the preferred embodiment of the present invention. Blister strip 100 comprises base 101, which is preferably constructed from a flexible, semi-rigid plastic, however, various other materials may be used including injected mold plastics, thick foil, etc. Blister strip 100 also comprises individual blisters 102. Individual blisters 102 are bubbles typically comprised of the same material as base 101 that protrude from the top of base 101 forming a cavity wherein a product may be stored. FIG. 1A illustrates individual blisters 102 containing capsules 103, however, capsules have been shown for exemplary purposes only. The individual blisters 102 of the preferred embodiment of the present invention may contain other forms of pharmaceutical drugs such as pills or tablets, or may contain non-pharmaceutical products such as machinery parts, toy cars, sewing kits, or any other product that may be stored within an individual blister. Furthermore, individual blisters 102 may hold a plurality of capsules or other such products.

Figure 9:
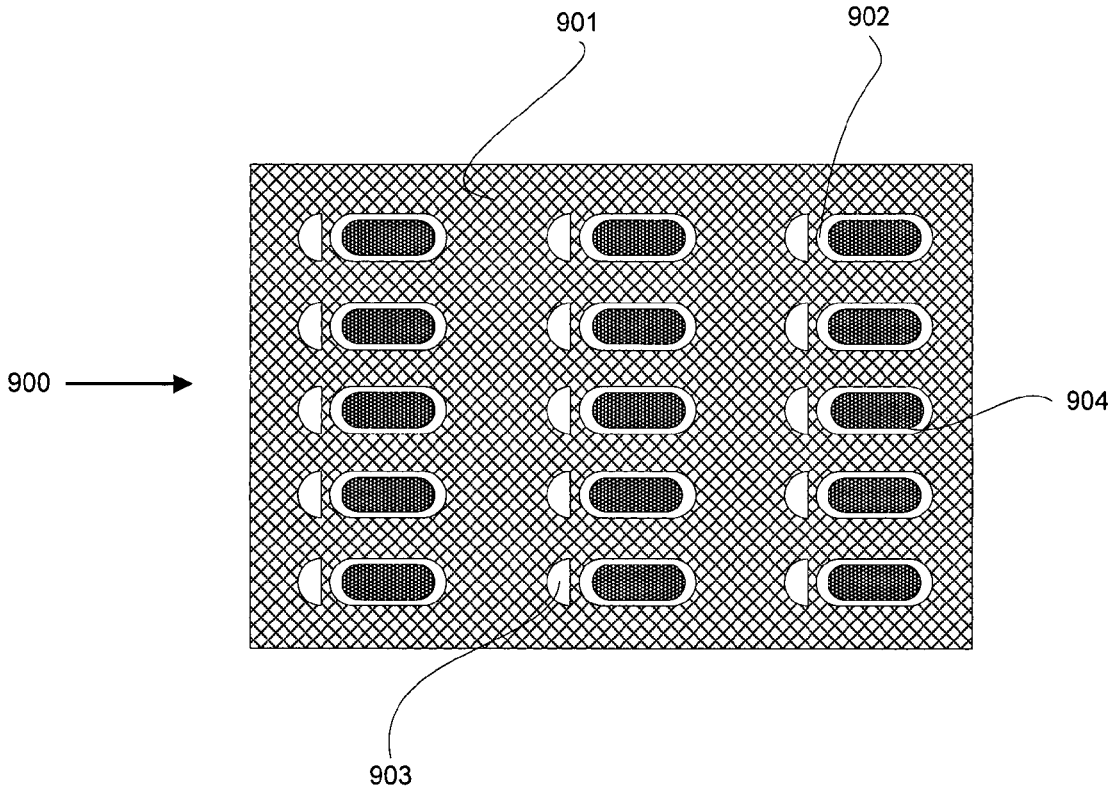
FIG. 9 depicts a front plan view of a solid form blister for use with the preferred embodiment of the present invention.
Figure 10:
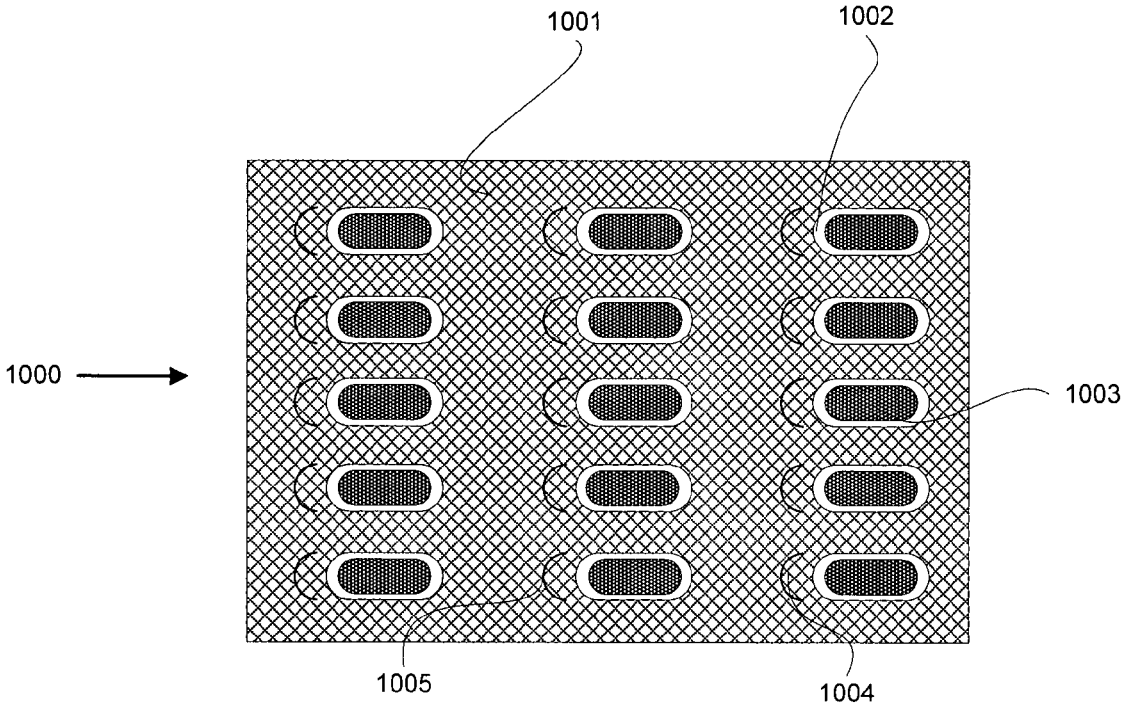
FIG. 10 depicts a front plan view of yet another alternative solid form blister for use with the preferred embodiment of the present invention.

Again for exemplary purposes, blister strip 100 is shown as a strip of five individual blisters 102. However, any number of individual blisters 102 in blister strip 100 may be used with the present invention. Moreover, individual blisters 102 may be arranged in a two-dimensional matrix, commonly referred to as a "solid form blister", as depicted in FIGS. 9 and 10. Furthermore, the blisters may be independently or irregularly arranged. Also, information regarding the contents of the blisters may be printed on blister strip 100 at any location to ensure subsequent identification. However, when blister strips are used to distribute pharmaceutical drugs for clinical trials, the identity of the blister contents may be withheld from the clinical trial participant, therefore, any identification information must be printed on blister strip 100 in a location that will be concealed when the blister strip 100 is placed within a blister card package. Also, the present invention may utilize cold-form blisters, or blisters that are formed from two sheets of foil such that a first sheet forms one or more individual blisters and a second sheet forms the seals.

Figure 1B:
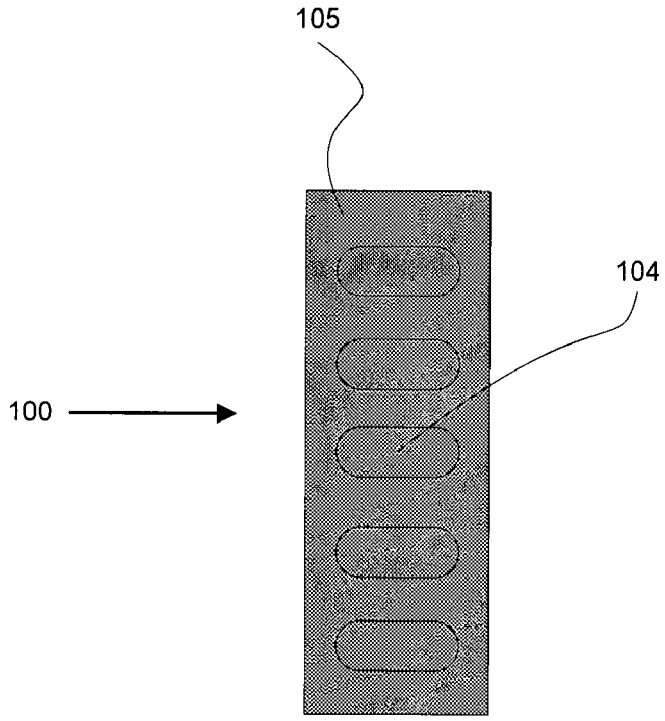
FIG. 1B depicts a rear plan view of the blister strip of FIG. 1A for use with the preferred embodiment of the present invention.

Turning to FIG. 1B, depicted is a rear plan view of blister strip 100, which illustrates backing 105, portions of which act as seals 104 for sealing the openings of corresponding individual blisters 102. Backing 105 is preferably constructed from aluminum foil, yet, other types of foil or other materials such as paper and plastic may be used. Additionally, backing 105 may comprise perforations or cut-scores surrounding the portion of the backing that coincides with the perimeter of the individual blister opening, i.e., seal 104. The perforations or cut-scores may be designed to assist the user in penetrating the portion of backing 105 that acts as seals 104 or pushing the content of the individual blisters 102 through seals 104.

Figure 1C:
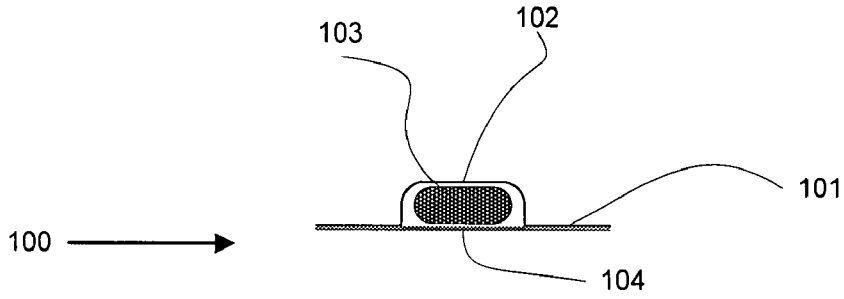
FIG. 1C depicts a side cross-sectional view of the blister strip of FIG. 1A for use with the preferred embodiment of the present invention.

FIG. 1C depicts a side view of blister strip 100. A user can easily remove any capsule 103 from its corresponding individual blister 102 by pushing downward (with respect to the horizontal plane) on individual blister 102 such that capsule 103 ruptures or displaces corresponding seal 104. Preferably, seals 104 of blister strip 100 are frangible to prevent damage to capsule 103 or other content of individual blister 102 when the content is pushed through the frangible layer. Individual blisters 102 are preferably constructed from a tear and puncture resistant, durable, flexible, semi-rigid material, thus allowing the user to push on individual blister 102 forcing capsule 103 through seal 104 while preventing breakage of capsule 103. Further, individual blisters 102 may be formed as indentations in base 101 or may be constructed from a different material that is adhered to base 101.

Figure 2:
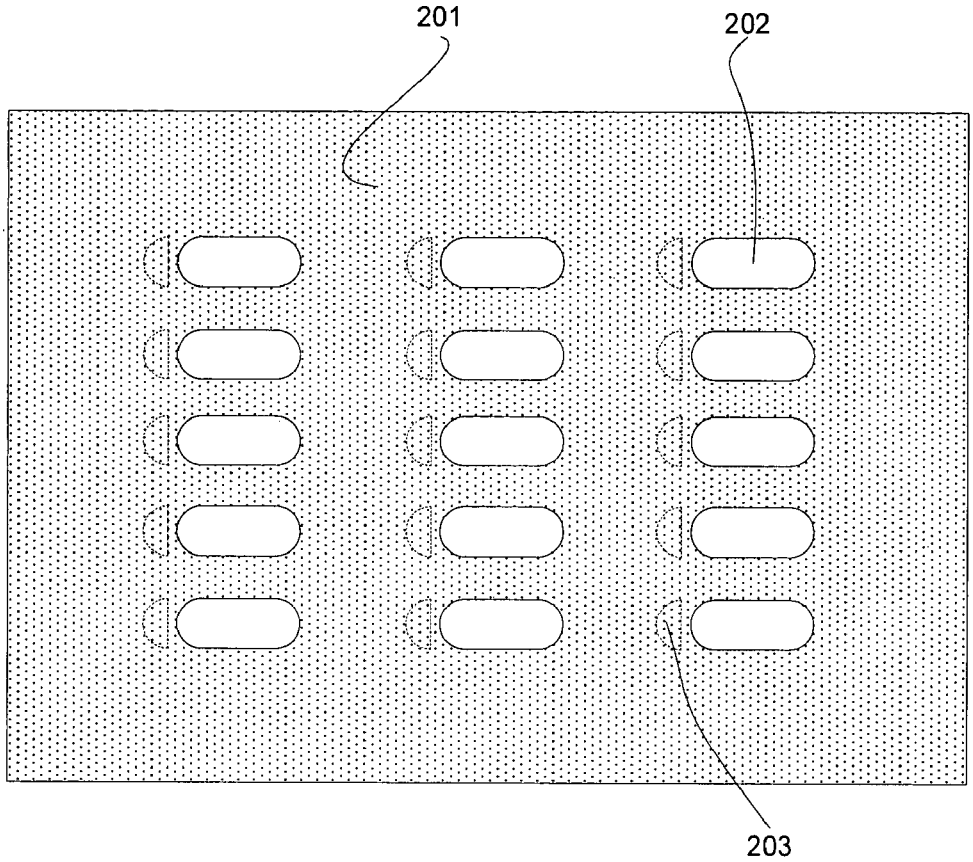
FIG. 2 depicts a front plan view of the front card of the blister card package of the preferred embodiment of the present invention.
Figure 3A:
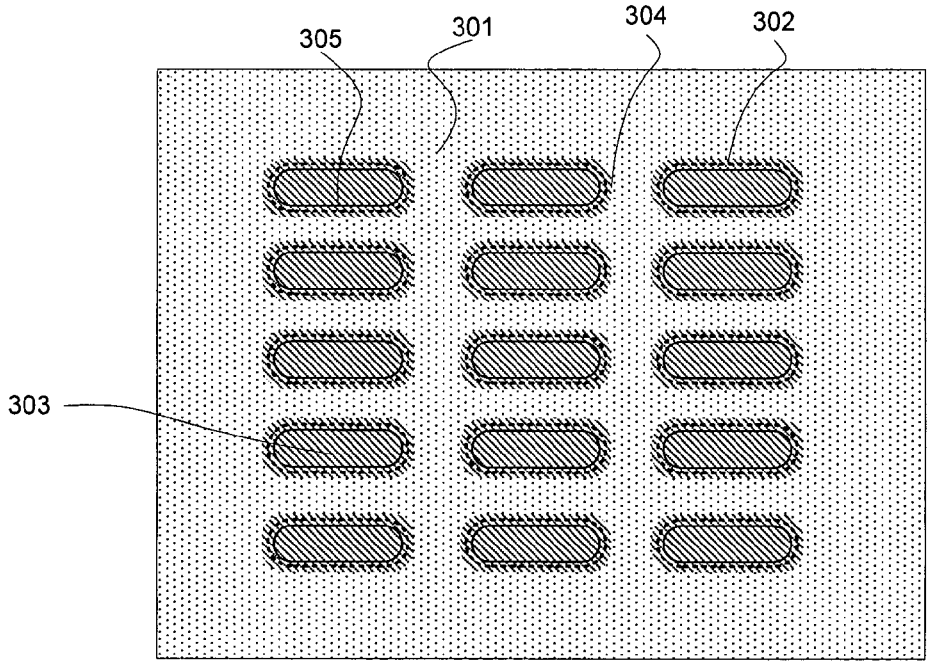
FIG. 3A depicts a front plan view of the rear card of the blister card package of the preferred embodiment of the present invention.
Figure 3B:
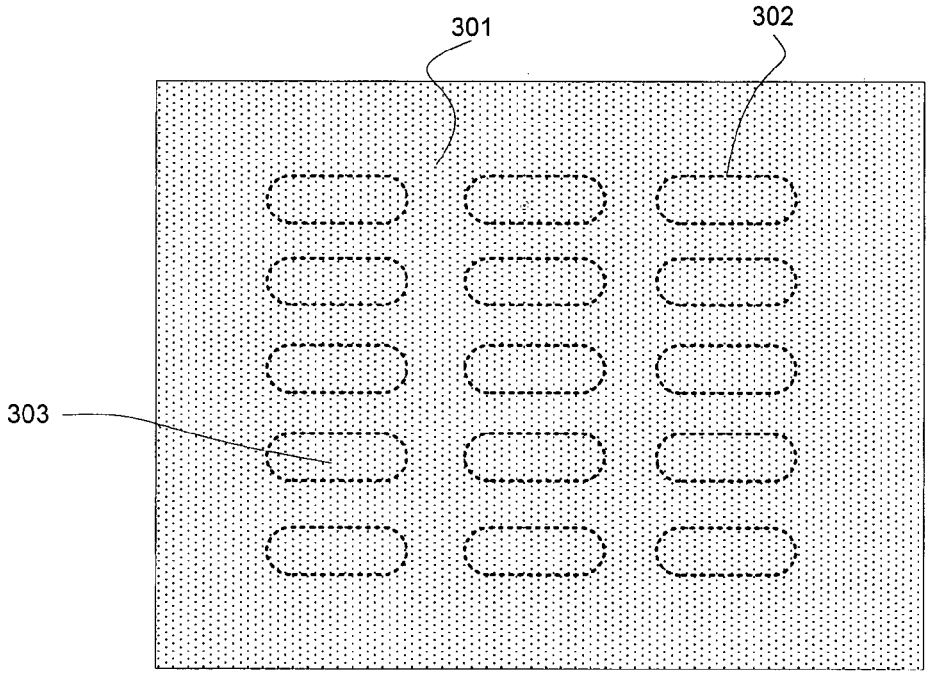
FIG. 3B depicts a rear plan view of the rear card of the blister card package of the preferred embodiment of the present invention.

As shown in FIG. 2-3B, the blister card package of the preferred embodiment of the present invention is constructed from front card 201 and rear card 301.

Front card 201 of FIG. 2 comprises a series of oval apertures 202. Oval apertures 202 are configured to match the size of individual blisters 102 (FIG. 1A), which are placed through oval apertures 202.

In the preferred embodiment of the present invention, the paperboard used to create front card 201 has one side that is pre-coated with a heat-activated adhesive. Purchasing paperboard with pre-applied adhesive reduces the cost of manufacturing. The paperboard of front card 201 is configured such that the rear of front card 201 is coated with the adhesive. Although the preferred embodiment of the present invention uses an adhesive activated by heat, an adhesive activated by some other means may also be used. Alternatively, front card 201 can be fabricated without adhesive, whereupon adhesive is applied during the assembly process, or a method other than adhesion may be utilized to assemble the blister card package.

For exemplary purposes, front card 201 comprises 15 oval apertures 202 forming a matrix comprising 3 columns and 5 rows. However, any configuration is possible without departing from the spirit of the present invention. In fact, the present invention may utilize irregular arrangements. Individual panels 203 are shown to the left of each oval aperture 202 and, preferably, panels 203 have a semicircular shape formed by perforated cuts. Alternatively a semicircular aperture may be cut into front card 201, but perforated cuts are generally preferred because the need to remove the "cut-out" material is eliminated. Nevertheless, the shape and position may vary without departing from the spirit of the present invention.

Front and rear views of rear card 301 are illustrated in FIGS. 3A and 3B, respectively. For the preferred embodiment of the present invention, rear card 301 is fabricated from paperboard purchased with a heat-activated adhesive pre-applied to one side of the paperboard, again, to reduce the cost of manufacturing. The paperboard of rear card 301 is positioned such that front of rear card 301 contains adhesive and the rear of rear card 301 does not. As described above for front card 201, an adhesive activated by some means other than heat may also be used. Alternatively, the rear card 301 can be fabricated without adhesive and adhesive may either be applied during the assembly process or a method other than adhesion may be utilized to assemble the blister card package.

Rear card 301 comprises perforated cuts 302 forming panels 303 that can be seen from both the front and rear of rear card 301. However, release coatings 304 and cut-scores 305 may only be seen from the front of rear card 301 as depicted in FIG. 3A. Cut-scores 305 are shown concentrically located within perforated cuts 302, however, depending on the material of rear card 301 and/or release coatings 304, implementing perforated cuts 302 concentrically within cut-scores 305 could be preferable. Additionally, the same type of cut could be used for both the inner and outer cuts. Any combination or quantity of cut types and locations may be used without departing from the spirit of the invention.

Cut-scores 305 are only visible from the front of rear card 301 because they do not penetrate the entire thickness of rear card 301. Rather, cut-scores 305 fully penetrate release coatings 304 and partially penetrate rear card 301. In contrast, panels 303 are cut throughout rear card 301 such that each panel 303 encircles its corresponding oval aperture 202 and semicircular panel 203 (FIG. 2) when the blister card packaging is fully assembled. The degree of perforation used to cut perforated cuts 302 may be altered to vary the force necessary to remove panel 303.

Without release coatings 304 and cut-scores 305, panels 303 are not likely to tear cleanly. The effect is similar to that observed when trying to tear a paper sticker from a surface. Often the paper separates into layers such that a top layer is torn from the sticker and a bottom layer remains adhered to the surface. Without release coatings 304 and cut-scores 305, the same result may occur when removing panels 303. Panels 303 may separate into layers such that one layer is removed and another layer remains attached to rear card 301 or seals 104 (FIG. 3A). This can cause difficulties when a user attempts to push capsules 103 through seals 104 (FIG. 1C). A user may not have sufficient strength to break though the remaining layer of paperboard, or, if the user applies additional force, the force required may damage capsules 103.

Release coatings 304 and cut-scores 305 ensure a clean removal of panel 303. The preferred embodiment of the present invention comprises a release coating 304 formed from a mixture of wax and Teflon®, however, other materials having similar properties may be used. Since the entire front of rear card 301 is coated with adhesive, release coatings 304 are applied to prevent panels 303 from adhering to seals 104 (FIG. 1B) during the adhesion process. Preventing this adhesion allows panels 303 to be cleanly removed while maintaining the low cost of manufacturing by allowing the paperboard to be purchased with pre-coated adhesive. Additionally, release coatings 304 may be colored to clearly indicate their presence or to help users, especially those with poor eyesight, locate semicircular panels 203 (FIG. 2).

Although the preferred embodiment of the present invention uses release coatings 304, it is also possible to construct the blister card package of the present invention without release coatings 304. Instead, paperboard can be purchased without pre-applied adhesive and the adhesive can be stamped onto the paperboard with a printing press such that adhesive is not applied to the areas slightly larger than the perimeters of panels 303.

Figure 3C:
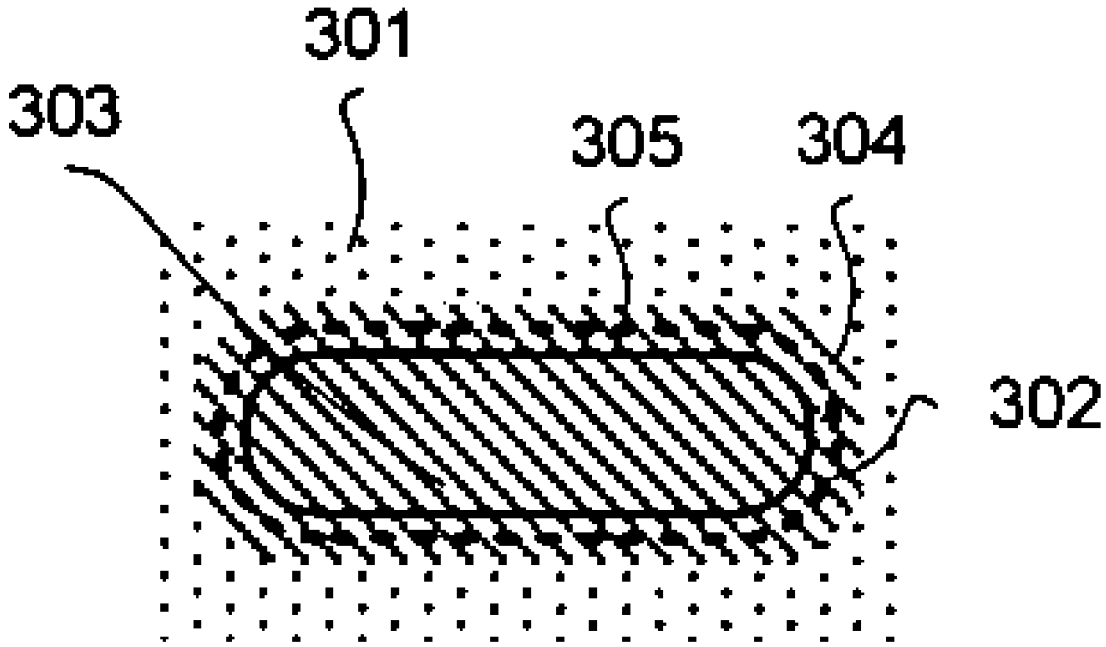
FIG. 3C depicts a magnified view of the die-cut portal, cut-score, and release coating of the rear card of FIG. 3A.

In the preferred embodiment of the present invention, release coatings 304 operate in conjunction with cut-scores 305, as depicted in FIG. 3C, to ensure a clean tear of panels 303. After a user partially removes panels 303 by pressing a tool through semicircular panels 203, panels 303 can be easily torn because panels 303 do not stick to seals 104 (FIG. 1B) and the tears follow the path of least resistance, i.e., cut-scores 305. Since release coatings 304 and cut-scores 305 are located internal to the blister card package and are not accessible from the exterior of the package, these two features assist in the clean tear of panels 303 only after panels 303 have been pushed with a tool, thereby maintaining the child-resistance of the blister card package.

The perforated cuts 302 and cut-scores 305 of the preferred embodiment of the present invention are die-cut. Moreover, perforations 302 and cut-scores 305 can be manufactured in a single step utilizing a combination of special die-cut knives. A first oval-shaped blade of the knife preferably has nicks (or a square saw tooth shaped edge) such that the blade creates perforations when pressed into rear card 301. A second oval-shaped blade is preferably recessed such that it only cuts partially through rear card 301, thereby forming cut-scores 305. Although cut-scores 305 do not extend through rear card 301, the use of a specially manufactured bi-level die, or positioning two die cutting knives at different levels, allows the rear card to be cut in one step, thereby reducing the cost of manufacturing.

Figure 4:
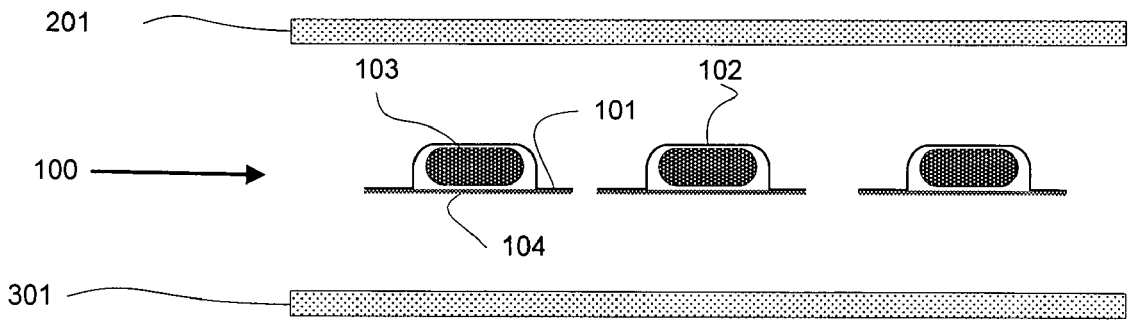
FIG. 4 depicts an exploded side view of the front card and rear card of the blister card package of the preferred embodiment of the present invention and the blister strip prior to assembly in accordance with the preferred embodiment of the present invention.

FIG. 4 depicts an exploded side view of front card 201, three blister strips 100, and rear card 301 prior to assembly. Individual blisters 102 are aligned with oval panels 203 (FIG. 2) and panels. 303 (FIG. 3B) of front card 201 and rear card 301, respectively.

Figure 5:
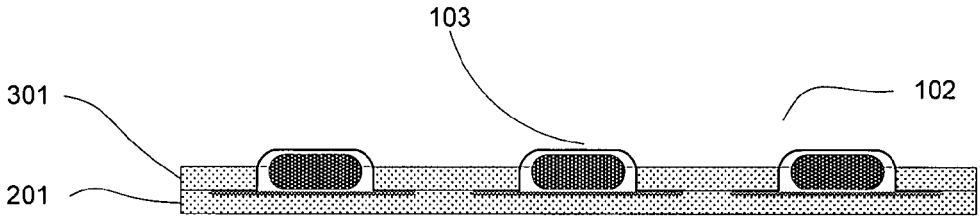
FIG. 5 depicts a side view of the assembled front card, rear card, and blister strip to create a blister card package in accordance with the preferred embodiment of the present invention.

Shown in FIG. 5 is a side view of front card 201, three blister strips 100, and rear card 301 after assembly. Individual blisters 102 protrude through oval apertures 202 of front card 201 (FIG. 2) such that they may be seen and manipulated by a user. Front card 201 is juxtaposed against rear card 301 such that bases 101 and seals 104 of blister strips 100 are encased between front card 201 and rear card 301. To secure the assembly, front card 201 and rear card 301 are preferably sealed to each other via application of heat and pressure. Preferably, portions of front card 201 and rear card 301 adhere to each other between blister strips 100.

To ensure proper operability of the blister card package, seals 104 of blister strips 100 (FIG. 1B) are preferably not heat sealed to panels 303 of rear card 301 (FIG. 3). Thus, seals 104 do not tear when panels 303 are removed. Additionally, a portion of panels 303 will not separate and remain attached to seal 104. Various manufacturing methods may be utilized to prevent adhesion of seals 104 to panels 303. One method is to avoid application of heat-activated adhesive to panels 303 or seals 104. For instance, adhesive may be applied only to front card 201 after oval apertures 202 and semicircular panels 203 are cut. Alternatively, the heat-activated adhesive may be applied to the entire front surface of rear card 301, and a specially designed heat-sealing plate having voids that correspond to panels 303 and seals 104 may be used to activate the adhesive only in desired areas. In the preferred embodiment of the present invention, release coatings 304 are applied to rear card 301 as shown in FIG. 3A and discussed above, thereby preventing adhesion of panels 303 to seals 104.

Preferably, front card 201 and rear card 301 are of sufficient size to be adhered around blister strips 100 (FIG. 1A) and to ensure child-resistance and durability. Although heat sealing is used for the preferred embodiment of the present invention, various other adhesion techniques may be applied. The present invention functions equally well with adhesives that do not require heat or pressure.

In an alternative embodiment, front card 201 and rear card 301 can be constructed from a single sheet of foldable paperboard. Consequently, the sheet can be folded and blister strips 100 inserted therein to assemble the blister card package. Additionally, to increase the durability of the invention, the paperboard may be at least partially laminated. Although paperboard is preferred, various other materials may be used without departing from the scope of the present invention.

Figure 6:
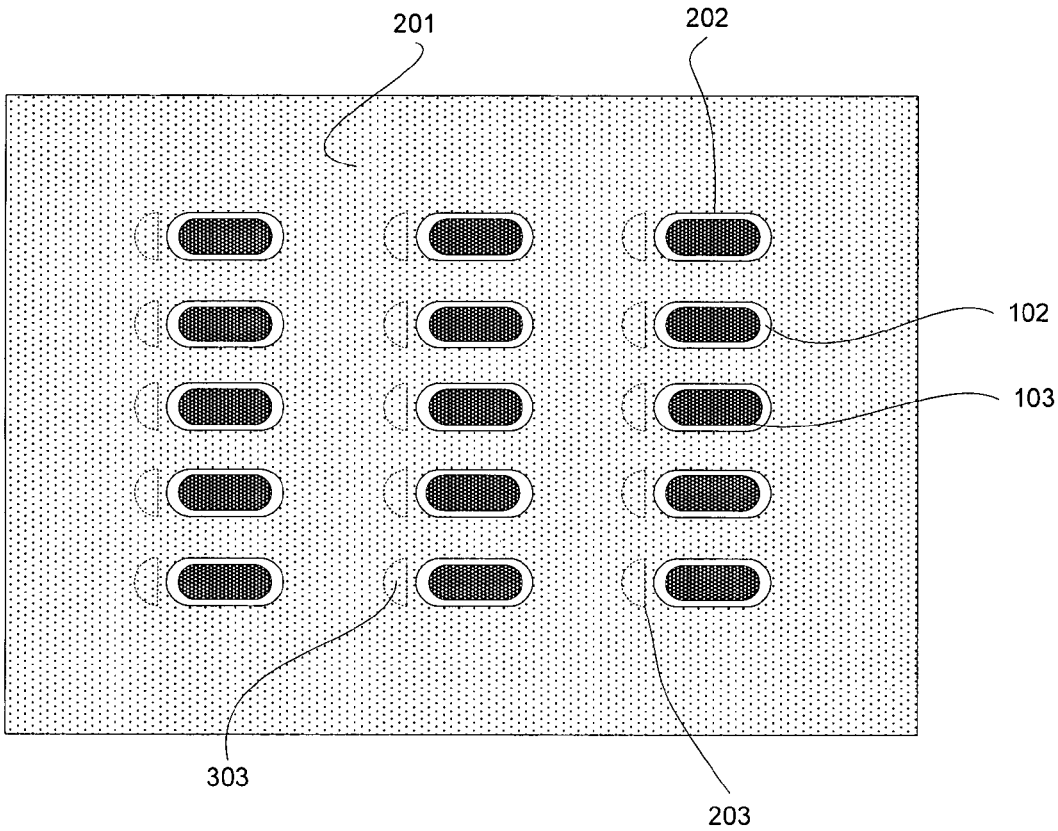
FIG. 6 depicts a front plan view of the assembled blister card package of FIG. 5 in accordance with the preferred embodiment of the present invention.

FIG. 6 depicts a front view of the assembled blister card package illustrated in FIG. 5. Individual blisters 102 protrude through oval apertures 202. The rear view of this embodiment is identical to the rear view of rear card 301 depicted in FIG. 3B. When the contents of individual blisters 102 need to be hidden, i.e., in a "double-blind" clinical trial, content information can be printed on base 101 of blister strip 100 of FIG. 1. As illustrated by FIG. 6, the content information printed on base 101 is hidden by front card 201 or rear card 301. Yet, in emergency situations, content information can be obtained by cutting or tearing apart the blister card package.

Figure 7:
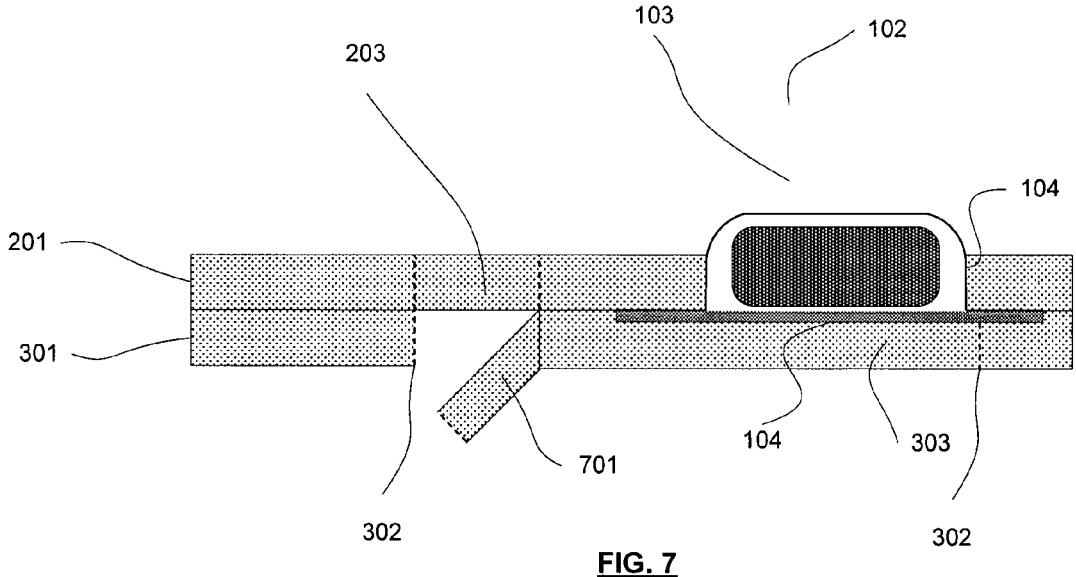
FIG. 7 depicts a magnified, cross-sectional view of the blister card package of the preferred embodiment of the present invention showing the formation of a pull-tab.

FIG. 7 depicts a side, cross-sectional view of the area proximal to each individual blister 102. When a user pushes downward (with respect to the horizontal plane) through semicircular panels 203 against panel 303, pull-tab 701 is created. The user may then pull pull-tab 701 to remove panel 303 along perforations 302 and expose seal 104. Once seal 104 is uncovered, flexible individual blister 102 may be pressed to force capsule 103 through seal 104. Importantly, the present invention is designed such that capsule 103 cannot be easily pressed through seal 104 and panel 303 when panel 303 is intact with rear card 301. This aspect of the preferred embodiment of the present invention helps achieve the federally mandated child resistance rating.

Ultimately, the present invention requires the user to perform a three-step, push-peel-push process that is cognitively challenging to children and mentally impaired adults, yet simple enough for competent individuals to understand, especially after reading the instructions. The steps can be summarized as follows: 1) Push a tool or fingernail through semicircular panels 203 to create pull tab 701; 2) Peel panel 303 away using pull tab 701; and 3) Push capsule 103 through seal 104.

Advantageously, paperboard can be easily printed on. Therefore, instructions and/or dosage information may be printed directly on the packaging. This not only prevents such information from getting lost, but also is convenient, especially for senior citizens who may be suffering from diminished cognitive skills. The method of manufacturing the preferred embodiment of the present invention includes a single step for applying release coatings 304 (of FIG. 3A) and printed information, thus minimizing the cost of manufacturing. Moreover, front card 201, rear card 301, or both, may be extended in one or more directions to provide additional area for printed information. Another advantage of paperboard is that it is easily written on, allowing a blister card package user to record information such as when medication was administered or side effects felt after taking the medication.

Figure 8:
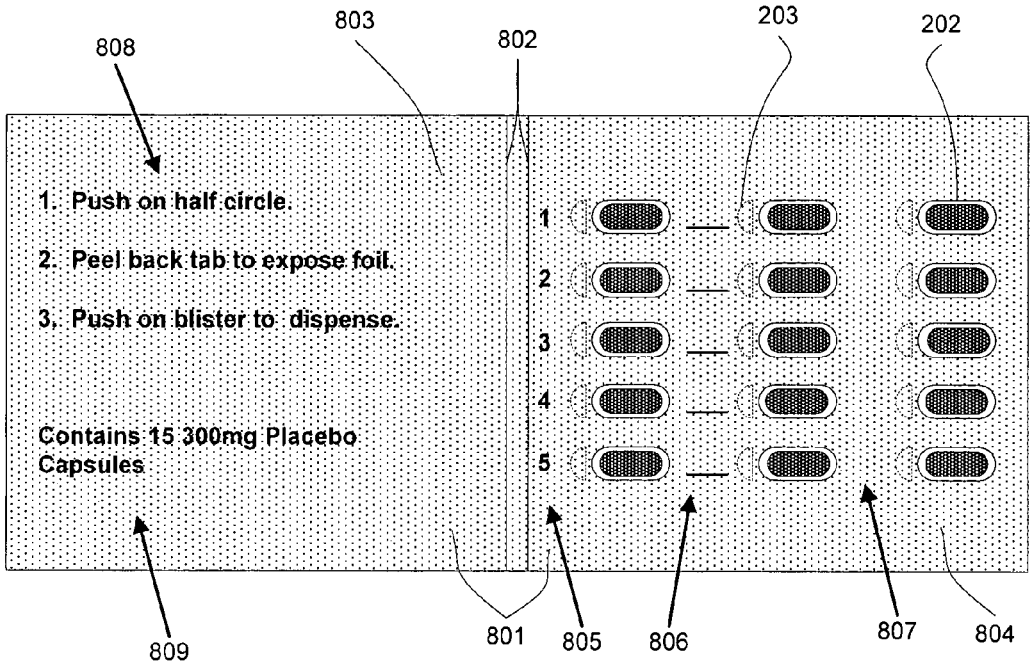
FIG. 8 depicts a front plan view of an unfolded blister card package of the preferred embodiment of the present invention having a foldable front cover comprising printed instructions, dosage information, and contents information.

The preferred embodiment of the present invention is shown in FIG. 8 with the front card 801 extended in the leftward direction. The rear card 303 (FIGS. 3A and 3B) may also be extended in this direction. Fold lines 802 are implemented such that the extended section, left flap 803, easily folds over front card 801. Front card 804 appears virtually identical to the embodiment of FIG. 6, except for the addition of printed information 805 and printed lines 806 adjacent to semicircular panels 203.

Printed information 805 may indicate dosage number, pill type, or any other relevant information. Alternatively, printed lines 80.6 may be printed or blank area 807 may be left to allow the user to record information. Left flap 803 comprises printed instructions 808 reading, "1. Push on half circle. 2. Peel back tab to expose foil. 3. Push on blister to dispense." Additional product information 809 may also be printed on left flap 803. The embodiment of FIG. 8 may be folded and placed into a casing comprising paperboard, or any other material, to protect the packaging and to prevent accidental and annoying unfolding. In further alternative embodiments, left flap 803 may also comprise blisters similar to right flap 804. Left flap 803 and rear card 301 (FIGS. 3A and 3B) may also be extended, folded, printed on, or constructed to hold materials to achieve the desired functionality without departing from the spirit of the invention.

Although the present invention has been shown encasing blister strips 100, as illustrated in FIG. 1, solid form blisters 900, depicted in FIG. 9, may also be encased. Solid form blister 900 comprises a two-dimensional matrix of blisters 902 connected to base 901 and containing capsules 904. Since solid form blister base 901 may interfere with the formation of a pull-tab (i.e., base 901 could block a user from pressing through the target area of the front card to create a pull-tab), semicircular apertures 903 are formed in the solid form blister base 901 adjacent to blisters 902. Semicircular apertures 903 are located to align with semicircular panels 203 of the front card 201 (FIG. 2). Preferably, semicircular apertures 903 are die-cut. As with blister strips 100, the openings of blisters 902 are enclosed with seals (not shown) similar to seals 104 of FIG. 1B. Therefore, solid form blister 900 can be encased between a front and rear card in the same manner described in the aforementioned embodiments of the present invention.

Alternative solid form blister 1000 also prevents interference with formation of a pull-tab. Blisters 1002 and capsules 1003 are similar to those in FIG. 9. However, in lieu of semicircular apertures 903 (FIG. 9), base 1001 comprises flexible flaps 1004 formed by semicircular cuts 1005. Thus, a user may push through flap 1004 to create a pull-tab. Semicircular cuts 1005 are preferably die-cut and may be a cut-score or perforated cut that penetrates the entire thickness of base 1003.

A solid form blister may be preferable when an entire blister card package will hold a single medication or object. In contrast, blister card packages intended to hold more than one medication or object may be more easily packaged with blister strips because each blister strip can hold a different medication or object. Furthermore, more than one blister strip (each holding a different medication or object) can be fitted into a single row or column of a blister card package.

Figure 11A:
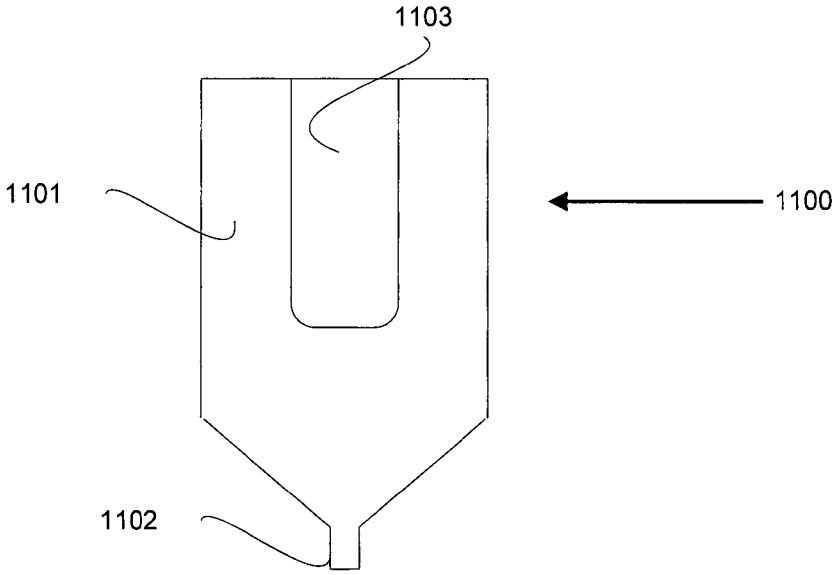
FIG. 11A depicts a front plan view of an opening tool for use with the preferred embodiment of the present invention.
Figure 11B:
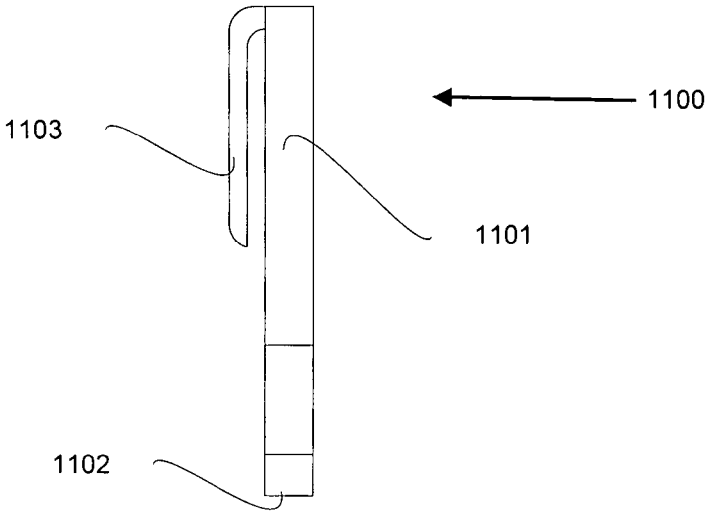
FIG. 11B depicts a side plan view of an opening tool for use with the preferred embodiment of the present invention.

Depending on the configuration, the blister card packages of the present invention may be difficult to open by users suffering from diminished physical abilities. In particular, arthritic users may experience difficulties pushing through a blister card to create a pull-tab. Therefore, the blister card packaging may include opening tool 1100 depicted from the front and the side in FIGS. 11A and 11B, respectively. Opening tool 1100 comprises handle 1101 and protruding member 1102. To prevent misplacement, clip 1103 may be included to attach opening tool 1100 to a blister card package. A user may hold opening tool 1100 by handle 1101 and force protruding member 1102 through a semicircular aperture of a front card to create a pull-tab. Notably, handle 1101 is relatively wide in one dimension for two reasons: 1) to allow easy grasping by arthritic users; and 2) to prevent accidental choking, especially by children. Handle 1101 is thin when viewed from the side, as shown in FIG. 11B. This slim design allows the opening tool 1100 to be compatible with and packaged with a blister card package.

While the present invention has been described with reference to one or more preferred embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

I claim:

1. An apparatus for packaging at least one object contained in a blister comprising:

a front panel having at least one aperture; and a rear panel having at least one removable section with at least two cuts in said rear panel along a perimeter of said at least one removable section;

wherein at least one of said two cuts defines said at least one removable section and at least one of said two cuts facilitates a clean tear of said at least one removable section, which is not removed by bending either of said front panel or said rear panel.

2. An apparatus for packaging at least one object comprising:

a front panel having at least one aperture; and a rear panel having at least one removable section with at least two cuts along a perimeter of said at least one removable section;

wherein said front panel and said rear panel are configured such that said at least one aperture aligns with said at least one removable section;

wherein said front panel and said rear panel are configured to hold at least one blister therebetween, said at least one blister comprising a backing and at least one protrusion containing said at least one object;

wherein said aperture is configured to receive said at least one protrusion;

wherein pressure applied to said at least one protrusion causes said at least one object to at least partially remove a portion of said backing and a portion of said at least one removable section from said rear panel; and wherein at least one of said at least two cuts defines said at least one removable section and at least one of said at least two cuts facilitates a clean tear of said at least one removable section, which is not removed by bending either of said front panel or said rear panel.

3. A method for removing an object from packaging, said method comprising:

exerting pressure on a target area of a front panel of said packaging such that a portion of a removable section of a rear panel of said packaging is removed, thereby forming a tab;

pulling said tab to remove said removable section from said rear panel of said packaging; and exerting pressure on a protrusion protruding from a first aperture of said front panel such that said object contained within said protrusion is pushed through a second aperture;

wherein at least one of two cuts defining said removable section facilitates said removable section to be cleanly peeled only when said removable section is pressed from said front panel, and further wherein said removable section is not removed by bending either of said front panel or said rear panel.

4. A method of manufacturing packaging for at least one object, said method comprising:

cutting a sheet of material to create a front panel such that at least one aperture is created for each object to be packaged; and cutting a second sheet of material to create a rear panel such that at least one removable section is created for each object to be packaged and said at least one removable section is defined by at least two cuts;

wherein a blister is inserted between said front panel and said rear panel;

wherein said at least one aperture receives a protrusion of said blister containing said object to be inserted through said at least one aperture; and wherein said at least one removable section contains at least one cut that facilitates clean removal of said removable section only when said removable section is pressed from said front panel, and further wherein said removable section is not removed by bending either of said front panel or said rear panel.

* * * * *